United States Patent [19]

Lande

[11] Patent Number: 4,656,672

[45] Date of Patent: Apr. 14, 1987

[54] ZIPPER NECKTIE

[76] Inventor: Martin Lande, 34 Glenmore Road, Hampstead, Quebec, Canada, H3X 3M6

[21] Appl. No.: 875,493

[22] Filed: Jun. 18, 1986

[51] Int. Cl.[4] ..... A41D 25/02

[52] U.S. Cl. ..... 2/150; 2/153

[58] Field of Search ..... 2/150, 153

[56] References Cited

U.S. PATENT DOCUMENTS

| | | | |
|---|---|---|---|
| 2,247,184 | 6/1941 | Burfening | 2/150 |
| 3,127,618 | 4/1964 | Roach | 2/150 |
| 3,737,917 | 6/1973 | Ore | 2/150 |
| 3,898,698 | 8/1975 | Byrd et al. | 2/150 |
| 4,513,453 | 4/1985 | Chen et al. | 2/150 |

*Primary Examiner*—Louis K. Rimrodt

*Attorney, Agent, or Firm*—Schwartz, Jeffery, Schwaab, Mack, Blumenthal & Evans

[57] ABSTRACT

A pretied necktie comprising a semirigid knot support, a front tie member fixed to and wrapped around the knot support, and a rear tie member having a loop-shaped, neck-encircling upper end which can be enlarged or reduced in size by means of a zip fastener comprising two continuous strings of interlockable elements that are symmetrically secured onto opposite portions of the loop and pass through a slider connected to the knot support. The slider comprises a small elongated hooking member integrally projecting from one of its side. This hooking member acts as the male element of a snap fastener. The female element of this snap fastener is defined by a small slot provided in the front wall of the knot support. The use of such a snap fastener makes the pretied necktie very easy to assemble.

9 Claims, 10 Drawing Figures

ZIPPER NECKTIE

BACKGROUND OF THE INVENTION (a) Field of the Invention

The present invention is concerned with a pretied necktie of the type comprising a semirigid knot support, a front tie member fixed to and wrapped around the knot support and a rear tie member having a loop-shaped, neck encircling upper end which can be inserted and adjusted around the neck of a wearer by means of a zip fastener forming part of it.

More particularly, the present invention is concerned with a pretied necktie of the above mentioned type, which is improved in that the semirigid knot support and the slider of the zip fasteners are provided with a set of cooperating snap fastening means that make them very easy to connect and thereby make the necktie very easy to manufacture and assemble.

(b) Brief Description of the Prior Art

Pretied neckties of the above mentioned type are already known and some of them even are commercially available. In this connection, reference can be made, by way of example, to U.S. Pat. No. 3,898,698 to BYRD et al. or to U.S. Pat. No. 4,513,453 to CHEN et al. Reference can also be made to copending patent application No. 801,694 filed on Nov. 1, 1985 to the name of the present inventor, Mr. Martin LANDE.

If all the existing pretied neckties of the above mentined type have numerous advantages, they also have a common known drawback, namely the fact that they are difficult to assemble. Indeed, the structure of all these known pretied neckties makes it compulsory to connect together, in one single step, the front tie member, the knot support and the gripping tab of the slider of the zip fastener, such a connection being usually carried out by means of a rivet. In addition of requesting some skill, this method of connecting the various elements of the neckties requires the use of a riveting machine, thereby substantially increasing the cost of the neckties.

Moreover, all the existing pretied neckties of the above mentioned ties have another common known drawback, namely the fact that they all tend to loosen during use, thereby requiring the wearer to readjust permanently the knot of the tie about his neck. Indeed, a problem with these known neckties is that the zip fastener used for varying the size of the neck encircling loop is never hard enough to prevent it from loosening during use.

To overcome this well known drawback, different solutions have been proposed up to now.

In U.S. Pat. No. 4,513,453, it is suggested to insert a M-shaped clamp as plug into the vertical hole of the knot support in order to lock the rear tie member in position. In copending Canadian patent application No. 494,395, it is suggested to use a stopper made of compressible foam. This stopper is slidably engaged into the vertical hole of the knot support in such a manner to engage the strings and lock the same. It is also suggested as an alternative in this copending Canadian patent application, to use strips of VELCRO fastener fixed to suitable parts of the front and rear tie members to lock them together once the neck encircling loop has been adjusted.

These proposed solutions are efficient in use. However, they require either clamps or stoppers that are not rigidly connected to the knot support and thus can be lost, or strips of VELCRO that must stitched and thus increase the amount of time and labour required in order to assemble the tie.

SUMMARY OF THE INVENTION

An object of the present invention is to provide an improved pretied necktie of the above mentioned type, whose structural elements are designed to be assembled in a very simple yet efficient manner, without requiring particular skill from those in charge of this assembly, nor requiring the use of a riveting or similar machine.

In accordance with the invention, this object is achieved by using snap fastening means for connecting the slider of the zip fastener with the rear side of the front wall of the knot support. The male element of these snap fastening means are connected to, or integral with,the slider whereas the female element is connected to, or integral with the rear side of the front wall of the knot support. Thus, it becomes very easy to connect the slider of the zip fastener to which the rear tie member is mounted , onto the knot support. It becomes also very easy to detach the rear tie member from the knot support whenever necessary.

Another object of the present is to provide an improved pretied necktie of the above mentioned type, which is further provided with very efficient yet simple means for braking or even completely preventing the movement of the rear tie member relative to the knot support in such manner as to retain the knot of the tie in position after the neck encircling loop has been adjusted around the wearer's neck.

The pretied necktie according to the invention has, as any conventional tie, a front tie portion, a knot portion, a neck encircling portion and a rear tie portion. It basically comprises a knot support having vertical front wall provided with front and rear sides. This knot support is made of a semirigid material, such as polyethylene plastic. The necktie also comprises a front tie member having an upper end fixed to the front side of the front wall of the knot support. This front tie member is wrapped around the knot support in such a manner as to form both the knot and front tie portions of the tie. In addition, the pretied necktie according to the invention comprises a rear tie member having an upper end formed as a loop. This rear tie member forms both the neck encircling and rear tie portions of the tie.

A zip fastener is provided for enlarging or reducing of the size of the loop and thus allowing insertion and adjustment of the necktie around the neck of a wearer. The zip fastener comprises two continuous strings of interlockable elements symmetrically stitched onto opposite portions of the loop. The zip fastener also comprises a slider in which the interlockable elements of the two strings pass and are cammed in, or uncammed from interlocked position. The slider is fixed to the rear side of the front wall of the knot support, whereby relative movement of the upper end of the rear tie member with respect to the knot support to which the slider is connected, causes the loop of this rear tie member to be increased or reduced in size.

In accordance with the invention, the structure of the above mentioned pretied necktie is improved in that it further comprises snap fastening means for connecting the slider of the zip fastener to the rear side of the front wall of the knot support. These snap fastening means comprise male and female elements that are detachably connectable to each other, the male element being rigidly connected to or integral with the slider, the female element being rigidly connected or integral with the front wall of the knot support.

Provided that the slider of the zip fastener is of conventional structure and comprises a small elongated hooking member integrally projecting from one of its sides for pivotably holding a gripping tab, use can be made of this small elongated hooking member as male element after having removed the gripping tab therefrom. In such a case, the female element of the snap fastening means may consist of a small slot provided in the front wall of the knot support, this slot being shaped and sized to receive and snap on the small elongated hooking member of the slider.

In accordance with another embodiment of the invention, the male element of the snap fastening means may consist of small hooking pin fixed to and projecting from one side of the slider. In such a case, the female element of the snap fastening means may consist of a standard snapping eye sized to receive the hooking pin.

In both cases, the knot support is preferably a hollow body having a kidney-shaped, vertical through-hole and a downwardly extending tongue forming part of its vertical front wall. Then, the small slot or snapping eye defining the female element of the snap fastening means are provided onto this tongue.

In both of these cases, the upper end of the front tie member can also be fixed in a very simple manner by a stample to the vertical front wall of the knot support just above the snap fastening means. This obviously makes the necktie according to the invention very easy to assemble, without any complicated machine.

In order to brake or even stop the movement of the rear tie member relative to the knot support and thus to retain the knot portion of the tie in position after the encircling portion has been adjusted the around wearer's neck, the slider of the zip fastener with the strings passing there through, can be hammered down prior to being connected to the front wall of a knot support. Such a hammering increases the pitching action of the slider onto the interlockable elements of the strings and thus achieve the required braking, in a very simple and inexpensive manner.

Alternatively, the rear side of the tongue of the knot support may be shaped so as to be in direct contact with, and to bear against the rear tie member on both sides of the slider when the same is snapped on, such a contact causing the tongue to act as a friction pad to retain the knot of the tie in position.

To lock the knot portion, use can also be made of a slider of the type comprising a locking pin pressed by a spring to normally engage the interlockable elements and lock the strings inside the slider, such a pin being mechanically connected to an operating tab. In such a case, the operating tab is mounted on and extends from the other side of the slider which is opposite the male element of the snap fastening means. Moreover, the operating tab is positioned in such a manner as to extend inside the vertical through-hole of the knot support and to bear against the rear wall of this knot support, whereby a mere pressure excited onto the rear wall of the knot support causes the operating tab to withdraw the locking pin and release the strings, such a release in turn allowing the neck encircling portion to be increased or reduced in size.

In accordance with a further preferred embodiment of the invention, the two continuous strings of interlockable elements consists of two different portions of a single zip fastener string of interlockable elements of symmetrical construction, stitched along the full lenght of the loop-formed upper end of the rear tie member. Once again, this feature makes the necktie according to the invention very easy to assemble.

BRIEF DESCRIPTION OF THE DRAWINGS

Some embodiments of the invention will now be described in greater detail, with reference to the accompanying drawings in which.

DESCRIPTION OF SEVERAL PREFERRED EMBODIMENTS

Figure 1:
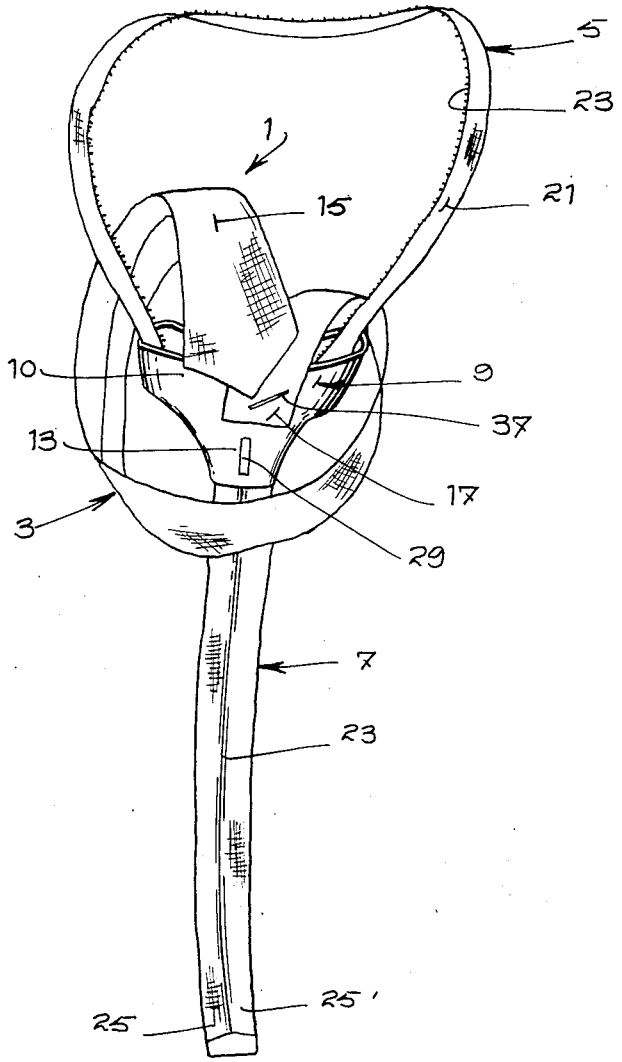
FIG. 1 is a front view of a pretied necktie according to the invention, illustrating the wrapping of the front tie member around the knot support to form the knot portion.

The pretied necktie according to the invention as shown in the accompanying drawings, has, as any conventional tie, a front tie portion 1, a knot portion 3, a neck encircling portion 5 and a rear tie portion 7.

As better shown in FIGS. 1, 2, 4 and 6, the pretied necktie basically comprises a knot support 9 made of semirigid material, such as plastic. The knot support 9 advantageously comprises a hollow body having a vertical front wall 10, a vertical rear wall 12, a kidney-shaped, vertical through-hole 11 in between the walls 10 and 12, and a downwardly extending tongue 13 forming part of the vertical front wall 10.

The pretied necktie also comprises a front tie member 15 having an upper end 17 fixed onto the front side of the front wall 10 of the knot support 9. This front tie member 15 is wrapped around the knot support 9 in such a manner as to form both the knot and front tie portions 3 and 1 of the necktie.

The pretied necktie further comprises a rear tie member consisting of a band of fabric 21 having one edge along the full length of which a single zip fastener string 23 of interlockable elements of symmetrical construction is stitched. This band 21 of fabric with its edging string 23 of interlockable elements is folded and manipulated in such a manner as to have both of its ends 25 and 25' passed simultaneously inside a zip fastener slider 27 which is itself connected to the rear wall of the tongue 13, just under the through-hole 11 of the knot support 9. In this slider 27, the opposite interlockable elements of symmetrical construction are cammed in interlocked position. The lower portion of the folded band 21, whose ends 25, 25' are joined under the slider 27, defines the rear tie portion 7 of the tie whereas the upper portion of the band 21 which forms a large loop, defines the neck encircling portion 5 of the tie.

Of course, relative movement of the upper end of the rear tie member with respect to the knot support 9 to which the slider 27 is connected, causes the neck encircling portion 5 defined by the loop formed by rear tie member to be increased or reduced in size.

As explained in the preamble of the present specification, this basic structure is already known per se and disclosed, by way of example, in copending Canadian Pat. No. 494,395 filed on Nov. 1st, 1985. By way of mere reference, it can be indicated that use can be made of the string sold by Y.K.K. CANADA INC. under the trademark 25 CF ZIPLON, as zip fastener string 23. Indeed, the interlockable elements of this particular string have proved to have the symmetrical construction with is necessary to make the rear tie member operable as disclosed hereinabove.

In accordance with the present invention, snap fastening means are provided for connecting the slider 27 of the zip fastener to the rear side of the front wall of the knot support 9.

Figure 3:
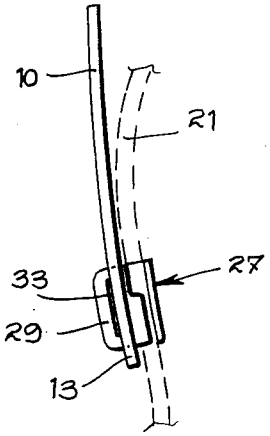
FIG. 3 is a side elevational, cross-section view of the knot support and slider assembly shown in FIG. 2.
Figure 2:
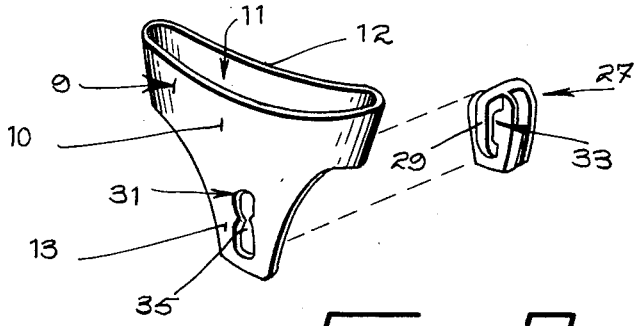
FIG. 2 is an exploded perspective view of a first embodiment of a knot support and slider assembly for use in the pretied necktie shown in FIG. 1.

In accordance with a first embodiment of the invention shown in FIGS. 2 and 3, these snap fastening means comprise a male element 29 which is integral to the slider 27, and a female element 31 which is integral to the front wall of the knot support 9, these male and female elements 29 and 31 being detachably connectable to each other.

In greater details, the male element 29 of the snap fastening means consists of a small elongated hooking member integrally projecting from one side of the slider 27. Such a hooking member 29 exists in most of the commercially available sliders, for use in pivotably mounting a gripping tab (not shown) for operating the zip fastener. Therefore, one can see that it is not necessary to modify in any way the slider 27 of the above mentioned type of zip fastener used in accordance with the present invention, to make this slider useful and operable. As a matter of fact, the only step to be taken to adapt a standard zipper to the present invention to remove the gripping tab from the hooking member 29.

The female element 31 of the snap fastening means advantageously consists of a small slot provided in the front wall of the knot support 9. As clearly shown in the accompanying figures, the slot 31 is shaped and sized to receive, and snap on, the small elongated hooking member 29 of the slider 27.

Usually, the elongated hooking member 29 of the slider 27 is provided with a transversal, slot-shaped through-hole 33 in which the gripping tab is pivotably mounted. In such a case, the small slot 31 provided in the front wall of the knot support 9 can be so shaped as defined a pair of opposite tongues 35 (see FIG. 2) sized to engage and snap in both sides of the through-hole 33 of the hooking member, when the same is inserted and pressed into the slot 31. Such an arrangement makes the connection of the male and female elements of the snap fastening means very reliable.

As clearly shown in the drawings, the slot 31 acting as female element of the snap fastening means, is advantageously provided in the tongue 13 which downwardly extends the vertical front wall 10 of the knot support 9. This particular positioning advantageously permits the upper end 17 of the front tie member 15 to be fixed onto the upper surface of vertical front wall 10 of the knot support 9, above the tongue 13. As shown in FIG. 1, such a fixation can be easily achieved by means of a stample 37. Once again, one can see that the various structural elements of the pretied necktie according to the invention are very easy to assemble even by an unskilled person, without any costly equipment. Indeed, the rear tie member 7 and the slider 27 can be merely snapped onto the rear side of the tongue 13 of a knot support 9. While the front tie member can be simply stampled onto the knot support 9, thereby making the whole necktie very easy to assemble.

Figure 4:
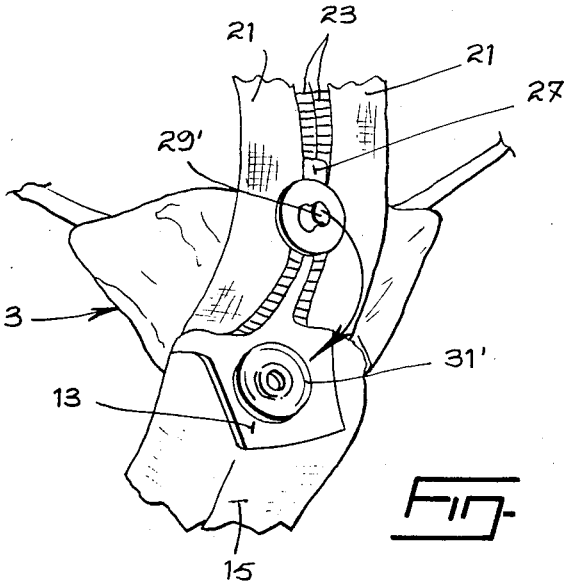
FIG. 4 is a bottom rear perspective view of a second embodiment of a knot support and slider assembly, showing the slider in detached position.
Figure 5:
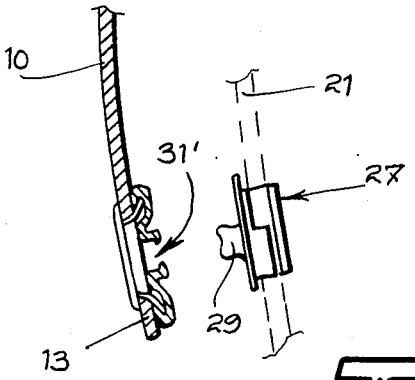
FIG. 5 is a side elevational, cross-section view of the knot support and slider assembly shown in FIG. 4, with the knot support and slider in detached position.

In accordance with another embodiment of the invention shown is FIGS. 4 and 5, the male element of the snap fastening means consists of a small hooking pin 29' fixed to and protecting from one side of the slider 27. In such a case, the female element of the snap fastening means consists of a snapping eye 31' sized to receive the hooking pin 29'. The hooking pin 29' and snapping eye 31' can be made of metal or plastic and can have any shape such as round as shown in FIG. 4, or square (to make them non-rotatable with respect each other). These elements 29' and 31' can be welded fixed or punched in any standard way onto the slider 27 and knot support 9, respectively. However, these pin 29' and eye 31' can also be made integral to the slider 27 and knot support 9. By way of example, when both of the knot support 9 and slider 27 are made of plastic material, the pin 29' and snapping eye 31' can be integrally molded therein.

As shown in FIGS. 4 and 5, the snapping eye 31' is preferably positioned onto the tongue 13 of the knot support 9. Once again, the upper end 17 of the front tie member can be fixed by a stample to the front wall 10 of the knot support, just above the snapping eye 31'.

To make the pretied necktie according to the invention very efficient in use, means can be provided for braking or even stopping the movement of the rear tie member relative to the knot support 9 in such a manner as to retain the knot support portion 3 of the tie in position after the neck-encircling portion 5 has been adjusted around the wearer's neck.

In accordance with the invention, such a braking can be achieved by merely hammering down the slider 27 of the zip fastener after having passed the strings 23 therethrough. Such a hammering can be made prior to connecting the slider 27 to the knot support 9, in order to increase the pitching action of the slider onto the interlockable elements of the strings and thereby make the sliding motion of these strings inside the slider more difficult. This of course allows the knot of the tie to stay in position after the neck encircling portion has been adjusted around the wearer's neck.

Figure 6:
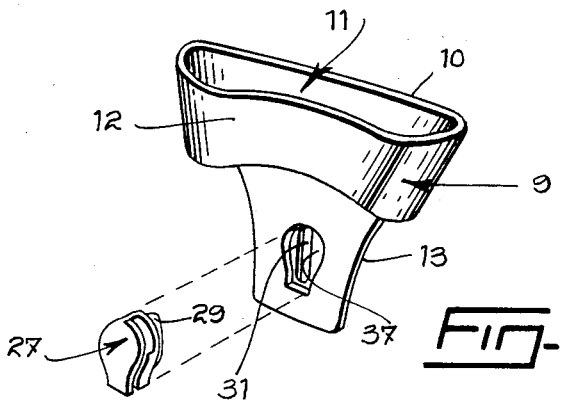
FIG. 6 is a rear perspective view of a variant of the assembly shown in FIG. 2.
Figure 7:
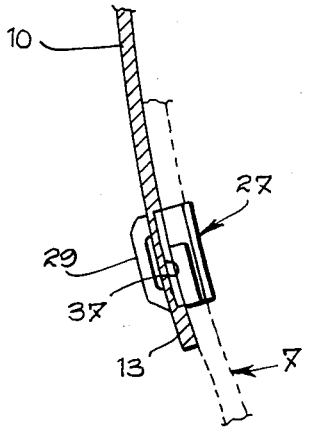
FIG. 7 is a side elevational, cross-section view of the variant shown in FIG. 6.
Figure 8:
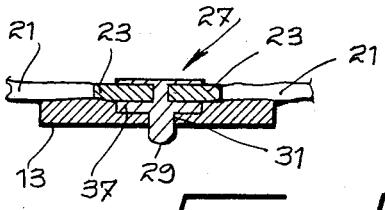
FIG. 8 is a top, cross-sectional view of the variant shown in FIGS. 6 and 7.

In accordance with the variant of the invention as shown in FIGS. 6 to 8, braking of the rear tie member can also be achieved by shaping the rear side of the tongue 13 of the knot support 9 in such a manner that it is in direct contact and bears onto the rear tie member 7 on both sides of the slider 29 when the same is snapped on in the small hole 31 is the tongue 13. To achieve such a contact and friction, the rear side of the tongue 13 can be provided with a small recess 37 whose depth is substantially equal to the thickness of the corresponding side of the slider 27. The recess 37 which extend all around the slot 31 can be sized to allow full insertion therein of the slider 27, as shown in the drawings. This in turn allows the rear side of the tongue 13 to come into contact with the band of fabric 21 forming the rear tie member 7 (see FIG. 8) and to act as a friction pad to retain the knot of a tie in position after the neck encircling portion 5 has been adjusted around the wearer's neck.

Figure 9:
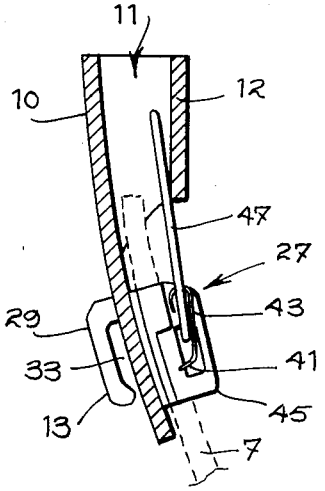
FIGS. 9 and 10 are side elevational, cross-section views of another variant of the assembly shown in FIG. 2, with the slider provided with a locking pin and an operating tag.
Figure 10:
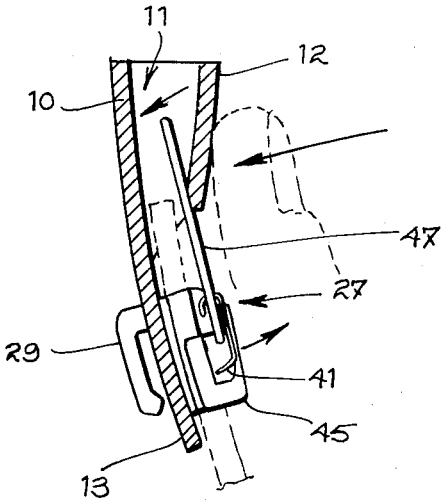

According to another variant shown in FIGS. 9 and 10, use can also be made of a slider 27 which, on one side, comprises a small elongated hooking member 29 and, on the other side, a locking pin 41 pressed by a spring 43 to normally engage the interlockable elements and thereby lock the strings inside the slider (see FIG. 9). The locking pin 41 and its spring 43 are both mounted inside another small elongated member 45 projecting from the other side of the slider 27. An operating tab 47 is pivotably mounted onto the member 45 and mechanically connected to the locking pin 41 either directly or via the spring 43 to raise the pin 41 and thereby release the strings whenever desired.

It is worth noting that this particular combination of a locking pin with an operating tab to lock the strings of interlockable elements of a zip fastener is very standard and manufactured by most of the zip fastener manufacturers. It is also interesting to note that sliders provided with gripping or operating tabs on both sides are also very common and used, by way of example, in the manufacture of the garments known as "reversible". However, to the applicant's knowledge, there is no slider presently available, having a mere gripping tab on one side and a combined locking-pin-operating tab assembly on the other side as disclosed hereinabove in the reference to FIGS. 9 and 10. As shown in FIGS. 9 and 10, the operating tab 47 in mechanical connection with the locking pin 41 is mounted and positioned in such a manner as to extend vertically inside the vertical through-hole 11 of the knot support 9 and bear against the rear wall 12 of this knot support. As can be seen, mere pressure exerted by a finger onto the rear wall 12 of the knot support which, as aforesaid, is made of semirigid plastic material, causes the operating tab 47 to withdraw the locking pin 41 from the interlockable elements of the strings and thereby to release these strings, such a release in turn allowing the tie encircling loop to be increased or reduced in size.

It is worth noting that the latter variant is particularly interesting since it is the only one which allows positive fixation and locking of the rear tie member with respect to the knot support.

I claim:

1. In a pretied necktie having, as any conventional necktie, a front tie portion, a knot portion, a neck encircling portion and a rear tie portion, said pretied necktie comprising:

a knot support made of semirigid material, said knot support having a vertical front wall with front and rear sides;

a front tie member having an upper end fixed to the front side of the front wall of said knot support, said front tie member being wrapped around the knot support in such a manner as to form both the knot and front tie portions of the necktie;

a rear tie member having an upper end formed as a loop, said rear tie member forming both of said neck encircling and rear tie portions of the necktie; and a zip fastener for enlarging or reducing the size of the loop and thus allowing insertion and adjustment of the pretied necktie around the neck of a wearer, said zip fastener comprising two continuous strings of interlockable elements symmetrically stitched onto opposite portions of the loop and a slider in which the interlockable elements of the two strings pass and are cammed in, and uncammed from, interlocked position, said slider being connected to the rear side of the front wall of the knot support whereby relative movement of the upper end of the rear tie member with respect to the knot support to which the slider is connected causes the loop of said rear tie member to be increased or reduced in size, the improvement wherein:

snap fastening means are provided for connecting the slider of the zip fastener to the rear side of the front wall of the knot support, said snap fastening means comprising male and female elements detachably connectable to each other, said male and female elements being rigidly connected to, or integral with, said slider and said front wall of knot support, respectively;

the slider of the zip fastener comprising a small elongated hooking member integral projecting from one of its sides;

the male element of the snap fastening means comprising said small elongated hooking member; and the female element of said snap fastening means comprising a small slot provided in the front wall of the knot support, said slot being shaped and sized to receive and snap on the small elongated hooking member of the slider.

2. The improved pretied necktie of claim 1, wherein:

the small elongated hooking member of the slider is provided with a tranversal, slot-shaped through-hole; and the small slot provided in the front wall of the knot support is so shaped as to define a pair of opposite tongues sized to engage and snap in both sides of the through-hole of the hooking member when the same is pressed into the small slot.

3. The improved pretied necktie of claim 2, wherein:

the knot support is a hollow body having a kidney-shaped vertical, through-hole;

said body has a downwardly extending tongue forming part of its vertical front wall;

the small slot defining the female element of the snap fastening means is provided in said tongue; and the upper end of the front tie member is fixed with a stample to the vertical front wall of the knot support abovesaid small slot.

4. The improved pretied necktie of claim 3 wherein the slider of the zip fastener with the strings passing therethrough, is hammered down prior to being connected to the front wall of the knot support, in order to increase the pinching action of said slider onto the interlockable elements of the strings and thus retain the knot of the tie in position after the neck encircling loop has been adjusted around a wearer's neck.

5. The improved pretied necktie of claim 4, wherein said two continuous strings of interlockable elememts consist of two different portions of a single zip fastener string of interlockable elements of symmetrical construction stretched along the full length of the loop-formed upper end of the rear tie member.

6. The improved pretied necktie of claim 3, wherein the rear side of the tongue of the knot support is so shaped as to be in direct contact with, and bear onto, the rear tie member on both sides of the slider when the same is snapped on in the small hole of said tongue, such a contact causing the tongue to act as a friction pad to retain the knot of the tie in a position after the neck encircling loop has been adjusted around a wearer's neck.

7. The improved pretied necktie of claim 6, wherein said two continuous strings of interlockable elements consist of two different portions of a single zip fastener string of interlockable elements of symmetrical construction stretched along the full length of the loop-formed upper end of the rear tie member.

8. The improved pretied necktie of claim 3, wherein:

the slider of the zip fastener further comprises a locking pin, pressed by a spring to normally engage the interlockable elements and lock the strings inside the slider, and an operating tab mechanically connected to said locking pin to raise the same and thus release the strings whenever desired;

said operating tab is mounted on and extends from the other side of the slider, which is opposite to the small elongated hooking member; and said operating tab is positioned in such a manner as to extend inside the vertical through-hole of the knot support and bear against the rear wall of said knot support, whereby a mere pressure applied onto said rear wall of the knot support causes said operating tab to withdraw the locking pin and release the strings, such a release in turn allowing the neck-encircling loop to be increased or reduced in size.

9. The improved pretied necktie of claim 8, wherein said two continuous strings of interlockable elements consist of two different portions of a single zip fastener string of interlockable elements of symmetrical construction stretched along the full lentgh of the loop-formed upper end of the rear tie member.

* * * * *